United States Patent [19]

Kollenberger, deceased

[11] 4,161,154

[45] Jul. 17, 1979

[54] STABILIZING DEVICE FOR SHIPS

[75] Inventor: Walter M. Kollenberger, deceased, late of Hamburg, Fed. Rep. of Germany, by Kathe L. M. Kollenberger, administratrix

[73] Assignee: Howaldtswerke-Deutsche Werft Aktiengesellschaft Hamburg und Kiel, Kiel, Fed. Rep. of Germany

[21] Appl. No.: 873,716

[22] Filed: Jan. 30, 1978

Related U.S. Application Data

[63] Continuation of Ser. No. 784,705, Apr. 5, 1977, abandoned, which is a continuation-in-part of Ser. No. 697,755, Jun. 21, 1976, abandoned, which is a continuation of Ser. No. 595,334, Jul. 14, 1975, abandoned.

[30] Foreign Application Priority Data

Jul. 17, 1974 [DE] Fed. Rep. of Germany ..... 2434257

[51] Int. Cl.[2] ..... B63B 39/00; B63B 43/02

[52] U.S. Cl. ..... 114/122; 114/121; 114/124

[58] Field of Search ..... 114/121-126; 214/10, 19, 90 R

[56] References Cited

U.S. PATENT DOCUMENTS

| | | | |
|---|---|---|---|
| 1,820,919 | 9/1931 | Massey | 244/10 |
| 1,927,538 | 9/1933 | Zaparka | 114/126 |
| 2,075,594 | 3/1937 | Throndsen | 114/126 |
| 2,985,406 | 5/1961 | Bump | 244/10 |
| 3,757,723 | 9/1973 | Pangalia | 114/126 |

*Primary Examiner*—Trygve M. Blix
*Assistant Examiner*—D. W. Keen
*Attorney, Agent, or Firm*—Stevens, Davis, Miller & Mosher

[57] ABSTRACT

A stabilizing device for a ship comprising two rotors housed one within the other for rotation in opposite directions and positioned on each side of the ship. The rotors are axially movable relative one to the other to permit the outer rotors to be alternately put into and out of action. Guide elements disposed downstream of the rotors and covering parts may be provided to reduce resistance to water flow.

3 Claims, 10 Drawing Figures

Fig. 5
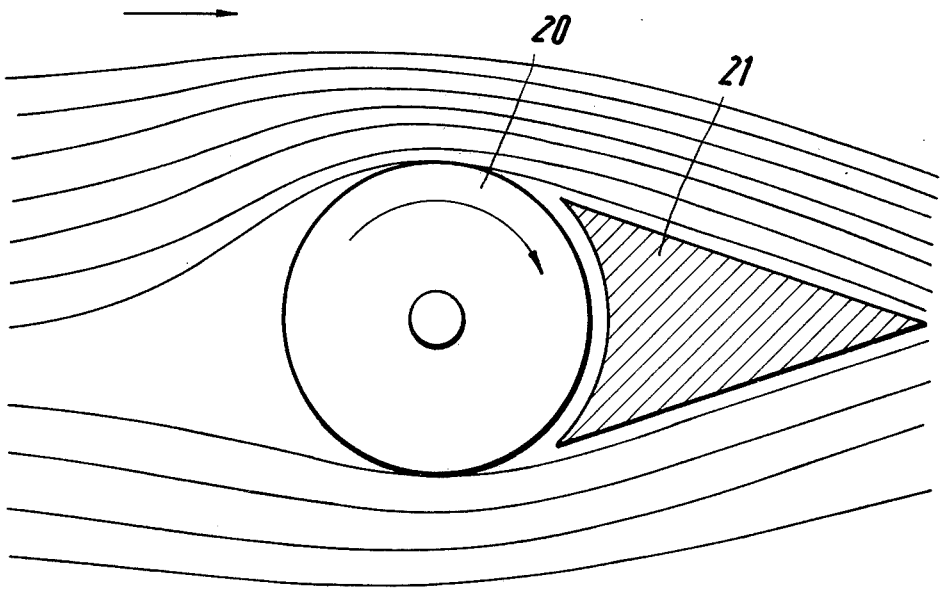
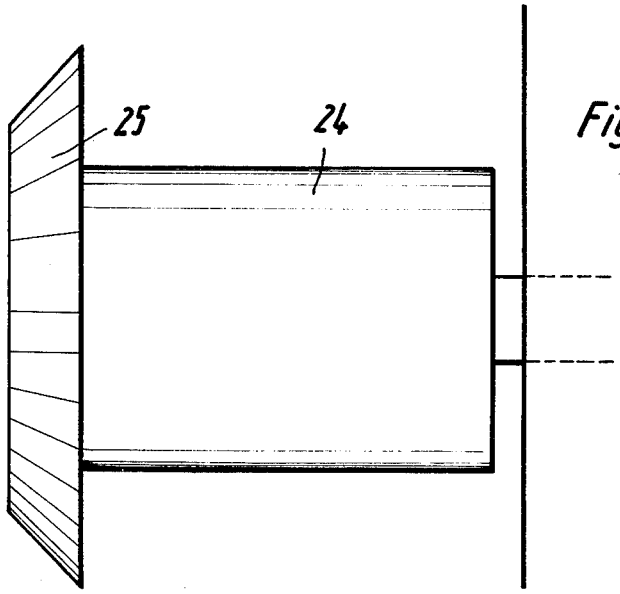
Fig. 6

114
115
a
a
132
137
136
135
6
131
120
111
112
5
125
126
123
124
132
119
118a
118
6
a
122
131
121
115

STABILIZING DEVICE FOR SHIPS

This is a Continuation of application Ser. No. 784,705 filed Apr. 5, 1977 which in turn is a continuation-in-part of application Ser. No. 697,755 filed June 21, 1976 now abandoned which in turn is a continuation of application Serial No. 595,334 filed July 14, 1975, now abandoned.

BACKGROUND OF THE INVENTION

1. Field of the Invention

This invention relates to a stabilizing device, particularly for ships, which utilizes stabilization parts projecting or adapted to be moved laterally out of the body of the ship.

2. Description of the Prior Art

In order to combat the rolling movement of ships a number of stabilizing devices have been proposed, including the use of anti-roll tanks, gyroscopes, or stabilization fins projecting laterally from the body of the ship on both sides and pivoting in dependence on the rolling movement of the ship. The use of such pivoting stabilization fins on both sides of a ship is in itself expedient, but these fins have certain disadvantages, particularly in that they are of relatively large dimensions and that they must necessarily be controllable, that is to say their angles of incidence must be continuously varied in dependence on the amplitude of the rolling movement of the ship and on each rolling movement must be reversed in their movement to a position of rest and vice versa. Furthermore, the power required by such stabilizing devices provided with pivoting stabilizing fins is relatively high.

SUMMARY

The problem underlying the invention is that of providing stabilizing devices, particularly for ships, in which the pivoting movement of the stabilizers is eliminated and the power required is considerably reduced, while nevertheless practically equally good stabilization, particularly of a ship, is achieved as when pivoting stabilizing fins are used.

The invention has the further aim of providing stabilizing devices, particularly for ships, which are substantially simpler in construction than the previously mentioned stabilizing fins.

To this end the invention takes as its starting point a stabilizing device, particularly for ships, which uses stabilizing parts projecting from each side of the body which is to be stabilized, and according to the invention the stabilizing device comprises at least one pair of rotors adapted to project laterally one from each of opposite sides of the body and to have the action thereof controllable, said rotors when in use being rotatable in directions opposite one to the other.

When such a rotor is used on each side of the body which is to be stabilized maximum buoyancy is achieved if its peripheral speed U is approximately 3.5 times as high as the speed of flow v of the water relative to the rotor; this means that with a speed of the ship of about 10 meters per second (about 19.5 knots) the peripheral speed of the rotor should accordingly amount to U=35 meters per second.

Assuming a rotational speed of the rotor n=1450 r.p.m., this gives a rotor diameter d of:

$$d = \frac{U \cdot 60}{n \cdot \pi} = \frac{35.60}{1450 \cdot \pi} = 0.462 \text{ m} = 462 \text{ mm}$$

If for example a fin having an area of 4 square meters (with a length of 2.67 meters and a depth of 1.5 meters) and having a coefficient of buoyancy approximately equal to 1.0 is replaced by a rotor attaining a coefficient of buoyancy equal to approximately 7, its area would have to be:

$$F_{rotor} = \frac{F_{fin} \cdot 1}{7} = 0.57\text{m}^2$$

With a diameter d=0.462 meters as calculated above, its length required is therefore:

$$L_{rotor} = \frac{F_{rotor}}{d} = \frac{0.57}{0.462} = 1.23 \text{ m} = 1230 \text{ mm}$$

The rotor is therefore substantially more advantageous in respect of space than the fin.

Through suitable selection of the speed of rotation of the rotor the ratio between the diameter and length of the rotor can be varied.

It is true that rotors of this kind have greater resistance to flow than fins, but within the scope of the invention suitable means can be provided to reduce this resistance.

In a preferred embodiment of the invention the rotors consist of cylindrical or substantially cylindrical bodies which are preferably in the form of hollow bodies.

Instead of a single rotor on each of the opposite sides of the body which is to be stabilized, the body may be provided with a plurality of pairs of rotors, for example two pairs of rotors, the rotors on one side of the body all being rotatable in the same direction and those on the opposite side of the body all being rotatable in the same direction but oppositely to the direction of rotation of the rotors on said one side of the body.

When two rotors rotating in opposite directions are disposed on each side of the body which is to be stabilized, the rotors may be disposed in suitable positions on the sides of the body which is to be stabilized, preference being given to an arrangement in which on each side of the body which is to be stabilized the rotors are so disposed that they do not mutually influence one another in their operation from the point of view of flow.

In another embodiment of the invention, when at least two rotors are used on each side of the body which is to be stabilized, the rotors can be disposed one within the other, in such a manner that the rotors are mounted coaxially. In this embodiment it is possible for the two outer rotors, that is to say one on each side of the body which is to be stabilized, to rotate in the same direction, while the inner rotors disposed inside the outer rotors likewise rotate in the same direction, but in the opposite direction of rotation to the outer rotors. In this embodiment it is necessary for the outer rotors to be brought into and out of an operative position relative to the inner rotors on each side of the body which is to be stabilized, in such a manner that an outer rotor of one side and an inner rotor of the other side work simultaneously in alternation with an inner rotor on one side and an outer rotor on the other side.

When use is made of a plurality of pairs of rotors disposed one inside the other on each side of the body which is to be stabilized, the pairs of rotors may either be driven in the same direction of rotation in relation to one another, as explained above, or the oppositely disposed pairs of rotors may be coupled crosswise, but in such a manner that the rotors in operation on opposite sides rotate in each case in opposite directions.

In addition to the embodiment in which it is possible for the rotors to be alternately retracted and extended, or to be alternately partly retracted and partly extended, according to another embodiment of the invention the operation of those rotors which are not to work can also be cancelled by alternately providing the rotors with covering elements, while their rotational movement is expediently continued for the purpose of saving energy.

In another embodiment of the invention the covering parts may be in the form of streamlined covering elements in order to maintain the most harmonious possible flow of water.

In another embodiment of the invention arrangements may be made to keep the flow resistance of the rotors as low as possible by achieving the most harmonious possible flow of water, for which purpose the rotors may be associated with guide elements, which are disposed downstream of the rotors and which have a shape favorable to flow.

The guide elements assisting flow may be combined with covering elements, if necessary, in order thereby to keep the flow resistance as low as possible even when one or the other rotor is not in operation.

In another embodiment of the invention the guide element or the covering elements combined with guide elements may be made adjustable or be extensible and retractable in proportion to the flow, in order to produce a predetermined buoyancy depending on the functioning of the rotor or rotors.

In another embodiment of the invention provision may be made to reduce the flow around the ends of the rotors, and to this end covering parts of suitable shape may be disposed at the outer ends of the rotors, which covering parts may be in the form of covering discs.

BRIEF DESCRIPTION OF THE DRAWINGS

FIG. 5 shows diagrammatically a rotor with a guide element disposed downstream of the rotor, FIG. 6 shows diagrammatically an elevation of a rotor having end covering parts.

DESCRIPTION OF THE PREFERRED EMBODIMENTS

Figure 1:
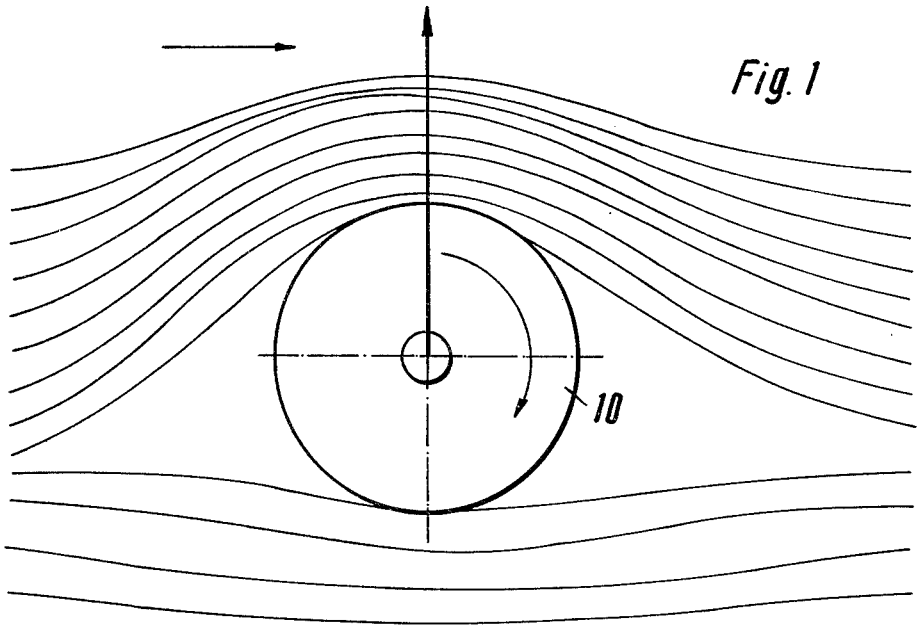
FIG. 1 shows schematically a flow diagram of liquid with a rotor turning in the clockwise direction.

Referring to FIG. 1, a rotor 10 turning in a clockwise direction forms a flow pattern in which as the result of the rotation, when the flow is from left to right in FIG. 1, acceleration of the flow of liquid takes place on the upper side of the rotor, while on the lower side of the rotor the flow of liquid is retarded. Consequently, a force is produced which urges the rotor in an upward direction.

If the rotor shown in FIG. 1 were to turn in the counterclockwise direction, while the direction of flow of the liquid remained unchanged, a force would be produced which would urge the rotor to move in a downward direction.

Use is made of this principle in the various embodiments of the invention.

Figure 2:
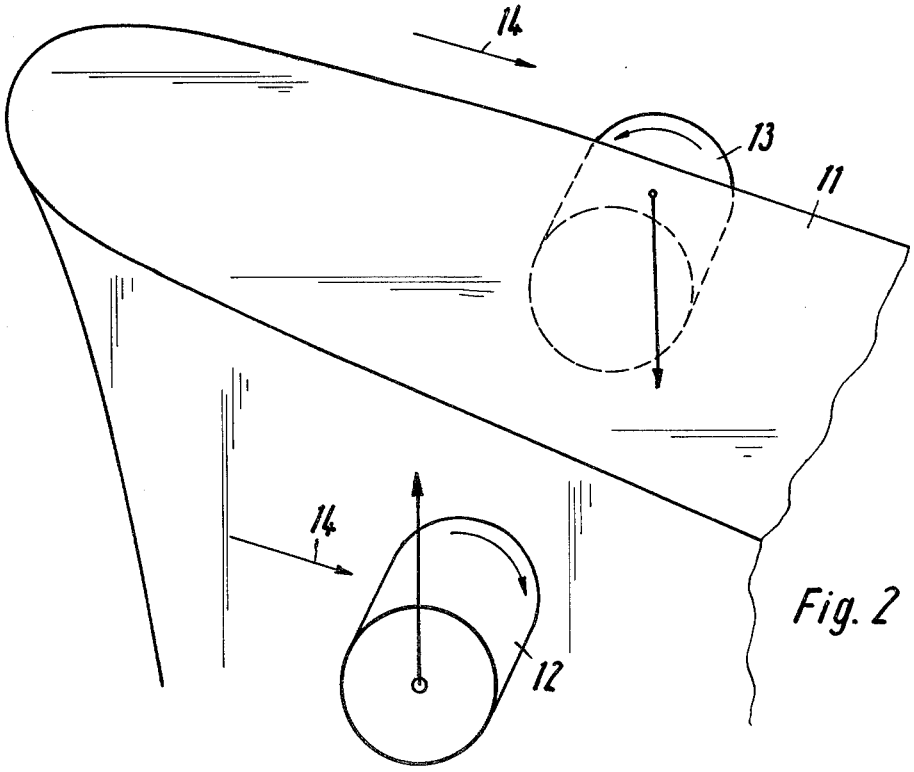
FIG. 2 shows diagrammatically part of a ship in which one rotor is provided on the port side and one on the starboard side.

In the embodiment shown in FIG. 2 the hull of a ship is designated 11 and on the hull there is disposed, below the waterline, a pair of oppositely disposed rotors 12 and 13 adapted to project laterally one from each of opposite sides of the hull. The rotors are cylindrical or substantially cylindrical bodies rotatable in opposite directions, as can be seen from the arrows shown. The direction of flow of the water is indicated by the arrows 14.

In dependence on the rolling movement of the ship in the starboard or port directions, one or the other of the rotors 12 or 13 is brought into action, in order to achieve the quickest possible return movement of the ship to the horizontal position against the tendency of the ship to roll.

Figure 3:
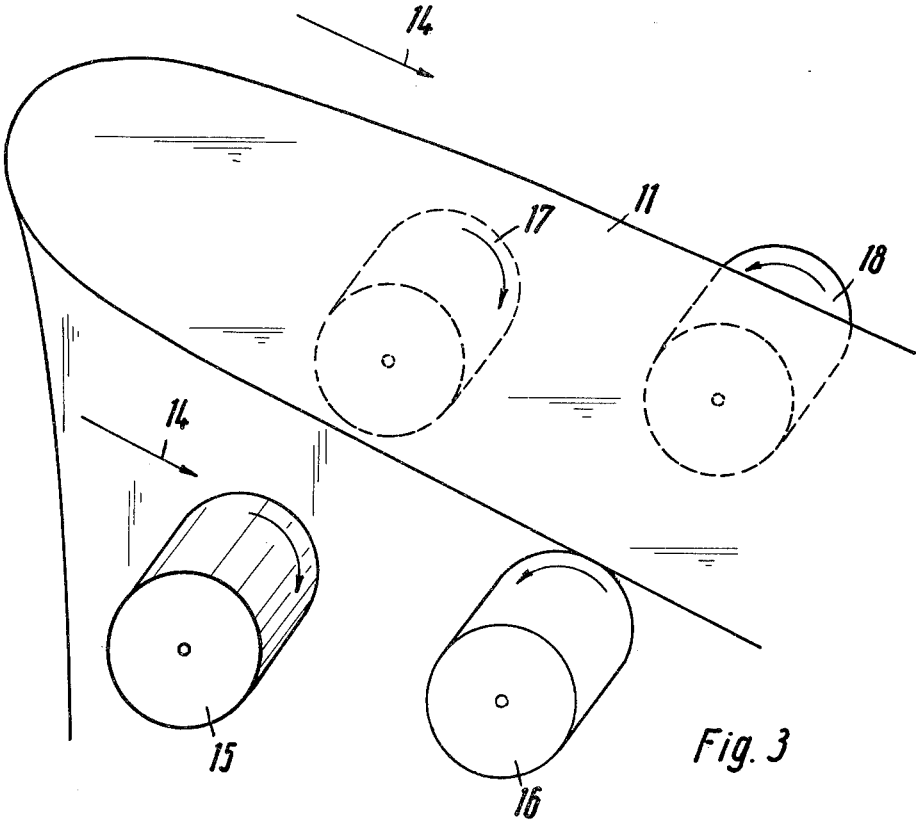
FIG. 3 shows an embodiment similar to that of FIG. 2 but in which two rotors are disposed on each side of the ship.

The action of the device can be further increased by providing, in accordance with the embodiment shown in FIG. 3, two rotors 15, 16 and 17, 18 respectively on each side of the ship 11, while the two rotors on each side of the ship rotate in opposite directions, as indicated by arrows. Depending on the rolling movement of the ship, one rotating rotor on each side of the ship 11 is then put out of action or put partly out of action by means which will be described later on, while on each side of the ship one rotor is brought into action, the rotors rotating in opposite directions, in order to achieve the quickest possible return movement of the ship to the horizontal position.

The rotors can be brought into and put out of action by alternately running the rotors 15, 17 and 16, 18 respectively in and out in opposite directions.

Figure 4:
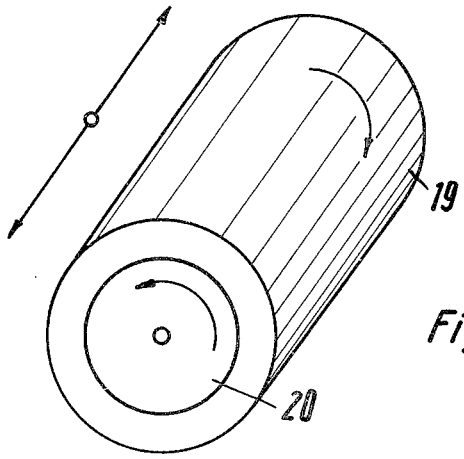
FIG. 4 illustrates a modification to FIG. 3 in which rotors are disposed one within the other on one side.

In FIG. 4, two rotors 19 and 20 are disposed one in the other on each side of a ship (which is not shown in this figure), while, as indicated by the arrows, on each side of the ship the rotors 19, 20 disposed one in the other can be alternately put into and out of action.

The number of rotors and their size and also their speed of rotation can be varied in dependence on the size and speed of the ship.

Figure 8:
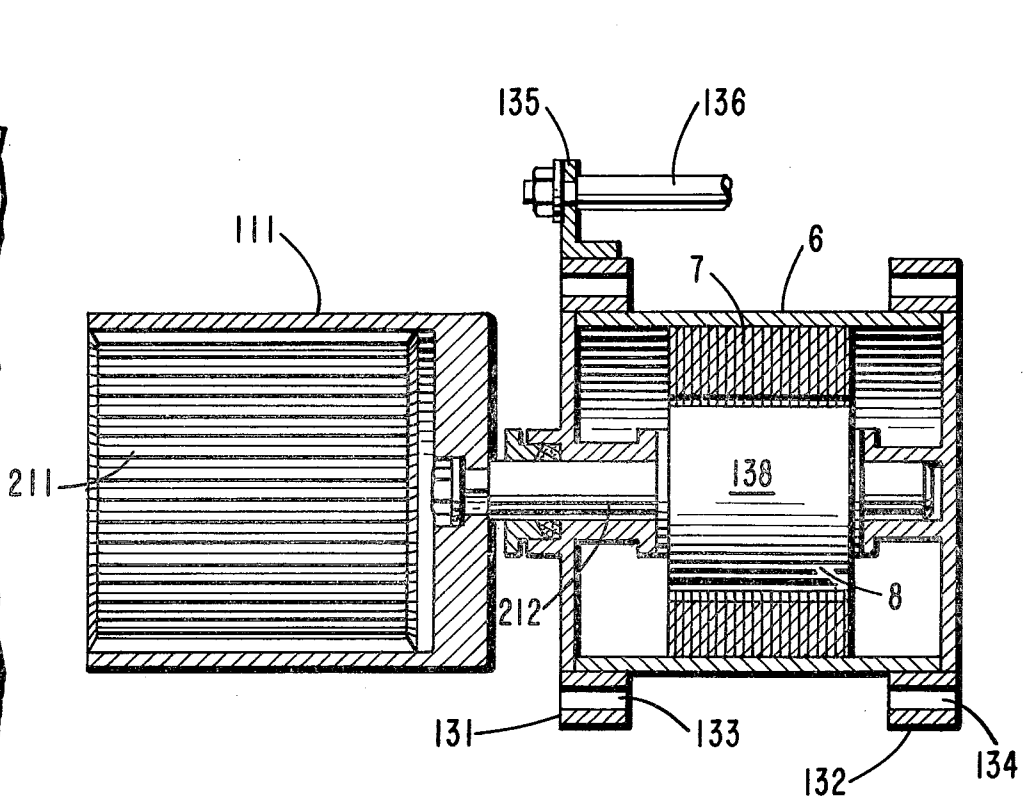
FIG. 8 shows a perspective view of the outer rotor with the corresponding drive, seen in cross-section.
Figure 7:
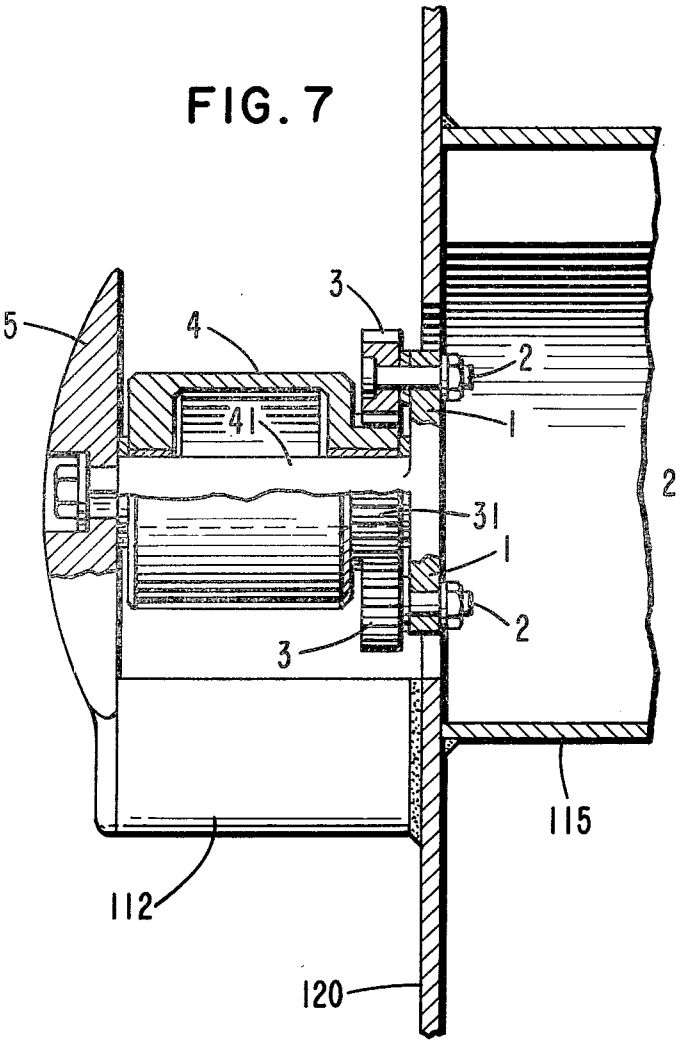
FIG. 7 shows a view of the inner rotor with the upper half in cross-section and the lower half in plain view.
Figures 9, 10:
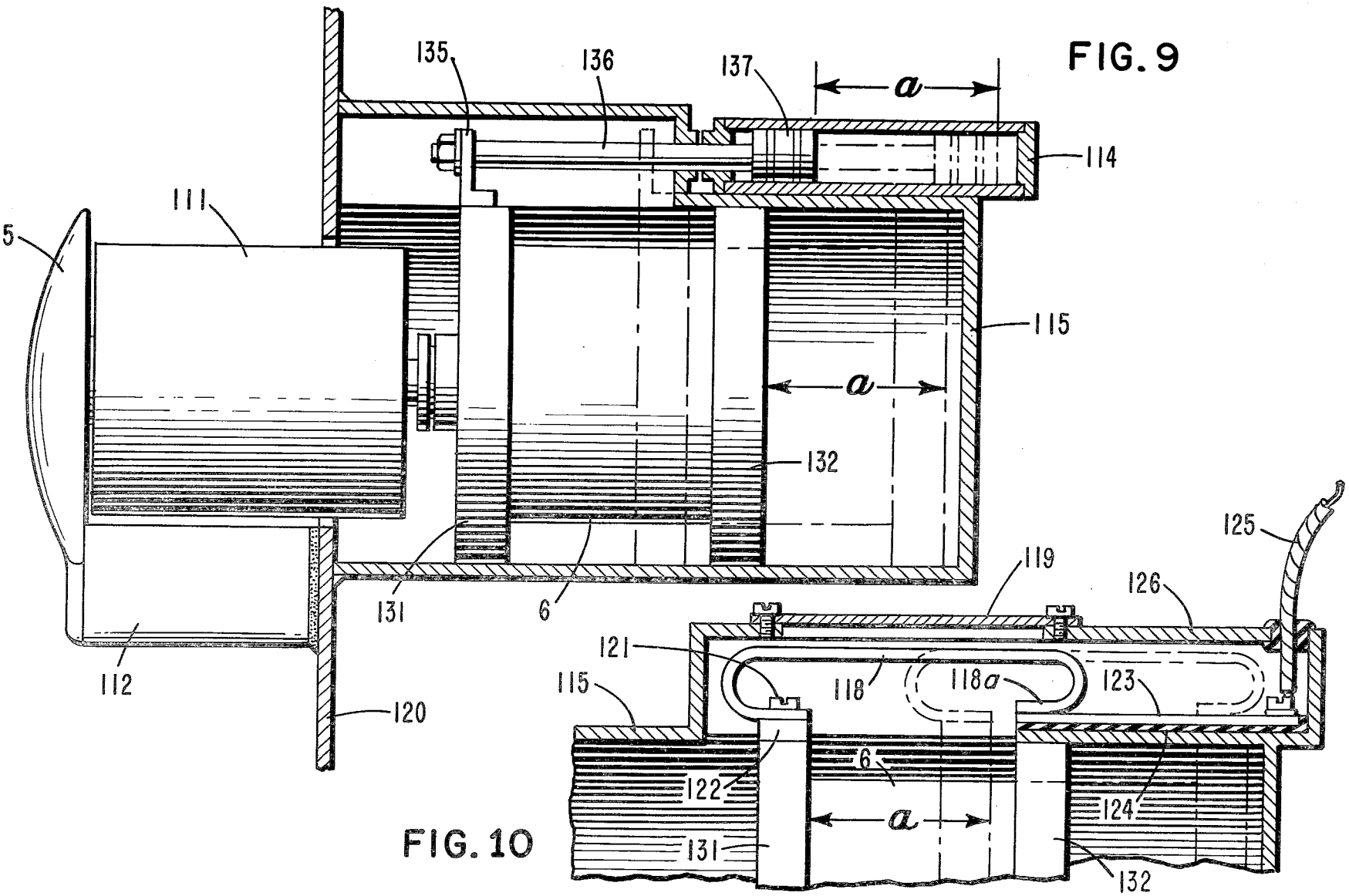
FIG. 9 is a diagrammatic showing of the outer rotor with the corresponding drive and the displacement device.
FIG. 10 is a partial elevation serving to explain how the drive motor is provided with energy.

Drives of a suitable type shown in FIGS. 7–9 in each case are provided for the rotors, while suitable control systems, for example gyroscopic control systems, may be provided, which in dependence on the rolling movement of a ship in each case put into or out of action a rotor or set of rotors.

In order to be able to put one of the inner rotors 20 on each side of a ship out of action, in the embodiment illustrated in FIG. 4 it is necessary for each of the outer rotors 19 to be made slidable, in such a manner that the outer rotors can be run into and out of the hull of the ship. In this case the arrangement is naturally such that in the case of sets of rotors 19, 20 disposed one in the other one outer rotor on one side of the ship and one inner rotor on the other side of the ship, or vice versa, can in each case work simultaneously. A plurality of pairs of rotors disposed one in the other may also be provided on each side of the hull which is to be stabilized.

In the embodiment shown in FIG. 5, which shows diagrammatically a rotor designated 20, a guide element designated 21 is provided downstream of the rotor 20 in the direction of flow, the guide element 21 serving the purpose of reducing flow resistance.

The guide element 21 may carry the axis of rotation of the rotor 20 if desired.

The guide element 21 may be adapted to be run into and out of the hull of the ship together with the rotor. Above the guide element 21 it is also possible to provide covering elements if required, in order to put one or the other rotor into or out of action, or at least partly out of action, in dependence on the rolling movement of the ship.

A covering element provided on the hull which is to be stabilized may be used additionally in certain circumstances for damping the rolling movement in order to produce a desired upward or downward component depending on the position of the covering element which has the form of a fin.

In order to reduce flow resistance, in the embodiment shown in FIG. 6 an end covering part 25 is provided for or joined to a rotor 24, its diameter being larger than the diameter of the rotor 24.

In the embodiment illustrated the covering part 25 has the form of a disc, but it may have any other desired shape.

FIG. 7 shows an inner rotor 4 which is rotatably supported on a shaft 41. The shaft 41 is provided at its end near the ship's side with arms 1 which are arranged 180° apart from each other. On the outer ends of each of the arms 1 there is a bolt 2, a gear 3 being rotatably supported on each bolt 2. Each of the gears 3 is in engagement with an outer toothing 31 which is arranged on the inner rotor 4. By rotation of the gears 3 the rotor 4 can thus be turned. FIG. 1 furthermore shows a cover part 5 which covers the rotor 4 off from the outside and on its part is firmly connected with a guide fin 112, in its turn connected to the outer wall 120 of the ship. The shaft 41 is firmly connected to the cover part 5.

In FIG. 8 the outer rotor 111 is shown in cross-section so that it can be seen that it consists essentially of a cylinder which is open on one end and closed on the other end. The outer rotor 111 is provided on the inner side with toothing 211 which extends essentially over the entire axial length of the rotor 111. The toothing 211 is so dimensioned that the gears 3 are in engagement with it in every axial position. The outer rotor 111 is furthermore firmly connected with a shaft 212 which is supported in a motor housing 6. Within the motor housing there is an electric motor 138 having a rotor 8 and a stator 7 which, as shown in FIG. 8, can be supplied with an electric current. The rotor 111 is either rigidly connected with the motor shaft 212 or connected with it via a suitable flange coupling. On both ends of the motor housing 6 there are provided, in axial direction, ring-shaped projections 131 and 132 which are slidingly displaceable on their outer circumference in a housing 115, so that the motor housing 6 is displaceably supported in axial direction. On the projection 131 there is a protruding part 135 to which a piston rod 136 is fastened. On the opposite end of the piston rod 136, a piston 137 is displaceably supported within a piston housing 114. The pressure-fluid feed lines to the piston housing 114 by which the piston can be moved in both directions are not shown.

There are also provided in the rings 131 and 132 of the motor housing 6, passage holes 133 and 134 which make it possible for sea water, which may be present within the housing 115, to flow from one side of the housing 115 to the other upon movement of the motor housing 6.

FIG. 10 illustrates a means for supplying electrical energy to the motor 138.

One end of a C-shaped sliding contact 118 is attached to ring 131 of motor housing 6 by screw 121 through insulating block 122. Screw 121 (and thus contact 118) is electrically connected to motor 138 inside housing 6. The other end 118*a* of contact 118 is spring biased for sliding electrical contact with conductor bar 123, which is insulated from housing 115 by insulation 124.

One side of the electrical circuit necessary to drive motor 138 is provided to conductor bar 123 by electrical conduit 125.

The above means are contained in housing 126 attached to and coaxial with housing 115.

An access cover plate 119 is provided on housing 126.

It is to be understood that a separate slide contact and conductor bar (not shown) are provided for the other side of the electric circuit.

Upon the assembling of the two rotors, the connection between the rotor 4 and the shaft 41 is first produced, the gears 3 having been previously fastened on the bolts 2 of the arms 1.

The outer rotor 111 is connected in known manner with the motor shaft 212 of the motor 138. Thereupon, the outer rotor 111 is closed over the inner rotor 4 in such a manner that the teeth 3 come into engagement with the toothing 211 of the outer rotor 111.

Thereupon the piston/piston-rod arrangement 137, 136 is mounted on the bracket 135 of the ring 131 of the motor housing 6. The housing 115 can then be fastened to the ship's wall 120, for instance by welding. After the connecting of the electric lines for the motor 138 and the hydraulic conduits to the piston housing 114, the arrangement can finally be placed in operation.

In FIGS. 9 and 10, a is the working stroke of the outer rotor 111. In order to bring the rotor 111 into the fully extended position, an operating fluid is introduced into the housing 114 from the right-hand side so that the piston 137 moves to the left. As a result of this movement, not only the rotor 111 but also the entire motor housing 6 are moved to the left, the projections 131 and 132 sliding, for instance, on a slideway. If the outer rotor 111 is to be moved inward, the pressure-fluid feed to the housing 114 is switched from the right-hand end to the left-hand end of the piston 137 so that the movement of the piston takes place in corresponding manner.

It is of course possible, instead of the piston/piston-rod arrangement 137 and 136, to provide a plurality of such arrangements distributed around the periphery of the motor housing 6. Furthermore, the projections 131, instead of being displaceably supported on one slideway, may be displaceably supported on two or more slideways, which in turn are distributed around the circumference of the motor housing 6.

Upon the driving of the electric motor 138 the outer rotor 111 turns in the same direction of rotation as the motor. The inner rotor 4 is turned in an opposite direction by the inner toothing 211 of the outer rotor 111 and the gears 3. The inward and outward movement of the outer rotor depends on the rolling motion, for instance of a ship. The circumferential velocity of the outer rotor, and thus also of the inner rotor, is adjustable as a function of the intensity of the rolling motion of the ship, which adjustment can be effected by suitable regulation of the electric motor 138.

As described the rotors can be put out of action by various means, for example by an arrangement in which individual rotors or a plurality of rotors can be run into and out of the hull of the ship, or if the rotors cannot be run in and out, by providing the desired covering parts for a rotor or a plurality of rotors and arranging the covering parts to be adjustable in a desired manner, for example so that they can be run in and out, while, as previously stated, the covering elements may if desired also be used as guide elements to reduce the flow.

In addition to the simpler construction of the drive for the rotors, an advantage provided by the invention consists in that by means of rotors in conjunction with covering elements a desired force component can in each case be obtained for the upward or downward movement of the hull which is to be stabilized. A particular advantage is that reversal of the direction of rotation of the rotors is not required, since the rotors always retain the same direction of rotation and their speed can be controlled in a simple manner.

What is claimed is:

1. A stabilizing apparatus for a body comprising inner and outer rotors arranged concentrically one within another and rotatable in opposite directions provided on each side of the body to be stabilized, means to move the outer rotors alternatively into and out of said body and means attachable to each side of said body to hold said inner rotors in a fixed relationship with said body.

2. The stabilizing apparatus of claim 1, wherein said means for said inner rotors includes a guide for reducing flow resistance.

3. The stabilizing apparatus of claim 1, wherein said means for said inner rotors includes a end disc for reducing flow resistance.

* * * * *